US012559932B2

(12) United States Patent
Jensen et al.

(10) Patent No.: US 12,559,932 B2
(45) Date of Patent: Feb. 24, 2026

(54) JOIST HANGER

(71) Applicant: Jenwest Enterprises LLC, Bluffdale, UT (US)

(72) Inventors: Mark Jensen, Bluffdale, UT (US); Nathan Jensen, Eagle Mountain, UT (US); Nicholas Jensen, Bluffdale, UT (US)

(73) Assignee: Jenwest Enterprises LLC, Bluffdale, UT (US)

( * ) Notice: Subject to any disclaimer, the term of this patent is extended or adjusted under 35 U.S.C. 154(b) by 342 days.

(21) Appl. No.: 18/339,131

(22) Filed: Jun. 21, 2023

(65) Prior Publication Data

US 2024/0426097 A1 Dec. 26, 2024

(51) Int. Cl.
*E04B 1/26* (2006.01)

(52) U.S. Cl.
CPC ..... *E04B 1/2612* (2013.01)

(58) Field of Classification Search
CPC ..... E04B 1/2612
See application file for complete search history.

(56) References Cited

U.S. PATENT DOCUMENTS 529,331 A * 11/1894 Lane ..... E04B 1/2612 217/65
1,097,934 A 5/1914 Price
3,601,428 A 8/1971 Gilb
3,633,950 A 1/1972 Gilb
3,907,445 A 9/1975 Wendt
3,945,741 A 3/1976 Wendt
3,989,398 A 11/1976 Wendt
4,005,942 A 2/1977 Gilb
4,330,971 A 5/1982 Auberger
4,353,664 A 10/1982 Gilb
4,422,792 A 12/1983 Gilb
4,480,941 A 11/1984 Gilb
4,841,690 A 6/1989 Commins
5,054,755 A 10/1991 Hawkes
5,071,280 A 12/1991 Turner
5,111,632 A 5/1992 Turner
(Continued)

OTHER PUBLICATIONS

Office Action for U.S. Appl. No. 16/002,320, mailed on Nov. 15, 2018.

(Continued)

*Primary Examiner* — Patrick J Maestri
(74) *Attorney, Agent, or Firm* — Workman Nydegger

(57) ABSTRACT

A joist hanger includes a mounting bracket and a joist retention member. The mounting bracket includes one or more vertical flanges, one or more horizontal flanges, and a pivot block extending in a first direction from the one or more vertical flanges. The pivot block includes one or more pivot features. The joist retention member is pivotally connected to the mounting bracket and includes first and second vertical support members. Each of the first and second vertical support members includes a pivot feature. The pivot features of the first and second vertical support members are configured to cooperate with the one or more pivot features of the pivot block to pivotally connect the joist retention member to the mounting bracket such that joist retention member can pivot about a generally horizontal pivot axis when the joist hanger is mounted on a wall.

17 Claims, 4 Drawing Sheets

(56) References Cited

U.S. PATENT DOCUMENTS

| | | | |
|---|---|---|---|
| 5,240,342 | A | 8/1993 | Kresa |
| 5,555,694 | A | 9/1996 | Commins |
| 5,564,248 | A | 10/1996 | Callies |
| 5,603,580 | A | 2/1997 | Leek |
| 5,778,625 | A | 7/1998 | Druffel |
| 5,941,044 | A | 8/1999 | Sera |
| 6,079,176 | A | 6/2000 | Westra |
| 6,123,745 | A | 9/2000 | Hess, III |
| 7,343,712 | B2 | 3/2008 | Shelton |
| 9,206,594 | B1 | 12/2015 | Grevious |
| 10,024,049 | B2 | 7/2018 | Brekke |
| 10,072,412 | B2 | 9/2018 | Brekke |
| 10,184,242 | B2 | 1/2019 | Brekke |
| 10,316,510 | B2 | 6/2019 | Brekke |
| 10,358,812 | B2 | 7/2019 | Jensen |
| 11,021,867 | B2 | 6/2021 | Brekke |
| 11,946,503 | B2 * | 4/2024 | Evans ..... F16B 9/052 |
| 2004/0244328 | A1 | 12/2004 | Bak |
| 2006/0191233 | A1 | 8/2006 | Tamlyn |
| 2007/0294979 | A1 | 12/2007 | Lin |
| 2008/0101855 | A1 | 5/2008 | Lin |
| 2009/0113839 | A1 | 5/2009 | Carr |
| 2012/0222382 | A1 | 9/2012 | Brekke |
| 2012/0297724 | A1 | 11/2012 | Pope |
| 2015/0167291 | A1 | 6/2015 | Bundy |
| 2015/0184370 | A1 | 7/2015 | Brekke |
| 2018/0038094 | A1 | 2/2018 | Brekke |
| 2021/0238841 | A1 | 8/2021 | Brekke |

OTHER PUBLICATIONS

Notice of Allowance for U.S. Appl. No. 16/002,320, mailed on Mar. 18, 2019.

* cited by examiner

JOIST HANGER

BACKGROUND

1. Technical Field

This disclosure generally relates to building materials and hardware. More specifically, the present disclosure relates to joist hangers.

2. Related Technology

The speed and efficiency of constructing a building, in addition to its structural integrity, are often dependent upon the tools or machines available to the skilled laborer. Additionally, the proper construction materials such as specialized hardware can be advantageous during the building process. Complicating the building process, however—including the selection of building materials, tools, and machinery that can be used at a given construction site—are additional considerations such as building regulations.

An exemplary set of building regulations include fire safety regulations. Briefly, certain structures and areas within buildings are often required to meet a minimum fire rating. Stairwells and elevator shafts, for example, are often required to have a minimum fire rating of two-hours. Accordingly, when constructing walls comprising and/or adjacent to a stairwell and/or elevator shaft, special considerations must be made to meet the two-hour fire rating standard. This commonly includes hanging fire resistant or retardant building material between a combustible frame and the building interior. However, currently available building materials and hardware are ill-suited and often cause additional work to be properly installed.

Accordingly, there are a number of disadvantages with building materials and hardware that can be addressed.

BRIEF SUMMARY

Implementations of the present disclosure solve one or more of the foregoing or other problems in the art with construction materials. In particular, one or more embodiments can include a joist hanger having a mounting bracket and a joist retention member pivotally connected to the mounting bracket. The joist retention member can be configured to pivot about a generally horizontal pivot axis when the joist hanger is mounted on a wall.

In another embodiment, a joist hanger includes a mounting bracket and a joist retention member. The mounting bracket includes one or more vertical flanges, one or more horizontal flanges, and a pivot block extending in a first direction from the one or more vertical flanges. The pivot block includes one or more pivot features. The joist retention member is pivotally connected to the mounting bracket and includes first and second vertical support members. Each of the first and second vertical support members includes a pivot feature. The pivot features of the first and second vertical support members are configured to cooperate with the one or more pivot features of the pivot block to pivotally connect the joist retention member to the mounting bracket such that joist retention member can pivot about a generally horizontal pivot axis when the joist hanger is mounted on a wall.

In another example embodiment, a joist hanger includes a mounting bracket, a joist retention member, and a pivot member. The mounting bracket includes one or more vertical flanges, one or more horizontal flanges, and a pivot block. The pivot block extends in a first direction from the one or more vertical flanges. The pivot block includes opposing sidewalls, each having a pivot aperture. The joist retention member is configured to be pivotally connected to the mounting bracket and includes first and second vertical support members. Each of the first and second vertical support members includes a pivot aperture in an upper end thereof. The pivot apertures of the first and second vertical support members are configured to be aligned with the pivot apertures of the pivot block. The pivot member is configured to extend through the pivot apertures of the pivot block and the first and second vertical support members to pivotally connect the joist retention member to the mounting bracket such that joist retention member can pivot about a generally horizontal pivot axis when the joist hanger is mounted on a wall.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments and is not necessarily intended to limit the scope of the claimed invention.

As provided above, there are a number of factors that can affect the efficiency, structural integrity, and speed at which a building is constructed. Particularly, fire regulations can affect how a building is built in addition to the types of materials that can be used at various locations throughout the building. For example, stairwells and elevator shafts are often required to maintain at least a two-hour fire rating. This often entails placing one or more layers of fire resistant or fire-retardant material between the building frame (e.g., a wooden frame) and an adjacent interior space.

Drywall is one of the most common fire-resistant materials used to create a fire barrier that meets the requisite fire-rating. In many implementations, two or more panels of drywall are secured to the frame, thereby establishing the requisite fire barrier. However, when utilizing drywall (or other similar fire retardant/resistant material) to create a fire barrier, other problems arise, particularly with respect to adjoining the fire-barrier wall with other walls, joists, trusses, etc. When considering the joist-wall connection in the absence of a fire barrier, for example, a standard joist hanger can be used to help secure the joist to the top plate and/or vertical support member of the wall. The same joist-wall connection becomes complicated when there are two intervening layers of drywall. It is often the case that the skilled laborer or crew of skilled laborers responsible for framing are often a different individual or crew of skilled laborers than those responsible for hanging drywall. Thus, during construction of a wall acting as a fire barrier, the framers are initially tasked with raising a frame. At that point, the drywall crew comes and hangs the drywall on the frame to create the fire barrier. The framers are called back once more to connect the joists (and other framing components) to the fire barrier wall.

The rotations of different crews and/or skilled laborers decreases efficiency, and other alternatives are fraught with similar inefficiencies or can additionally, or alternatively, cause an inadvertent violation of the regulations related to the fire-rating.

Figure 1:
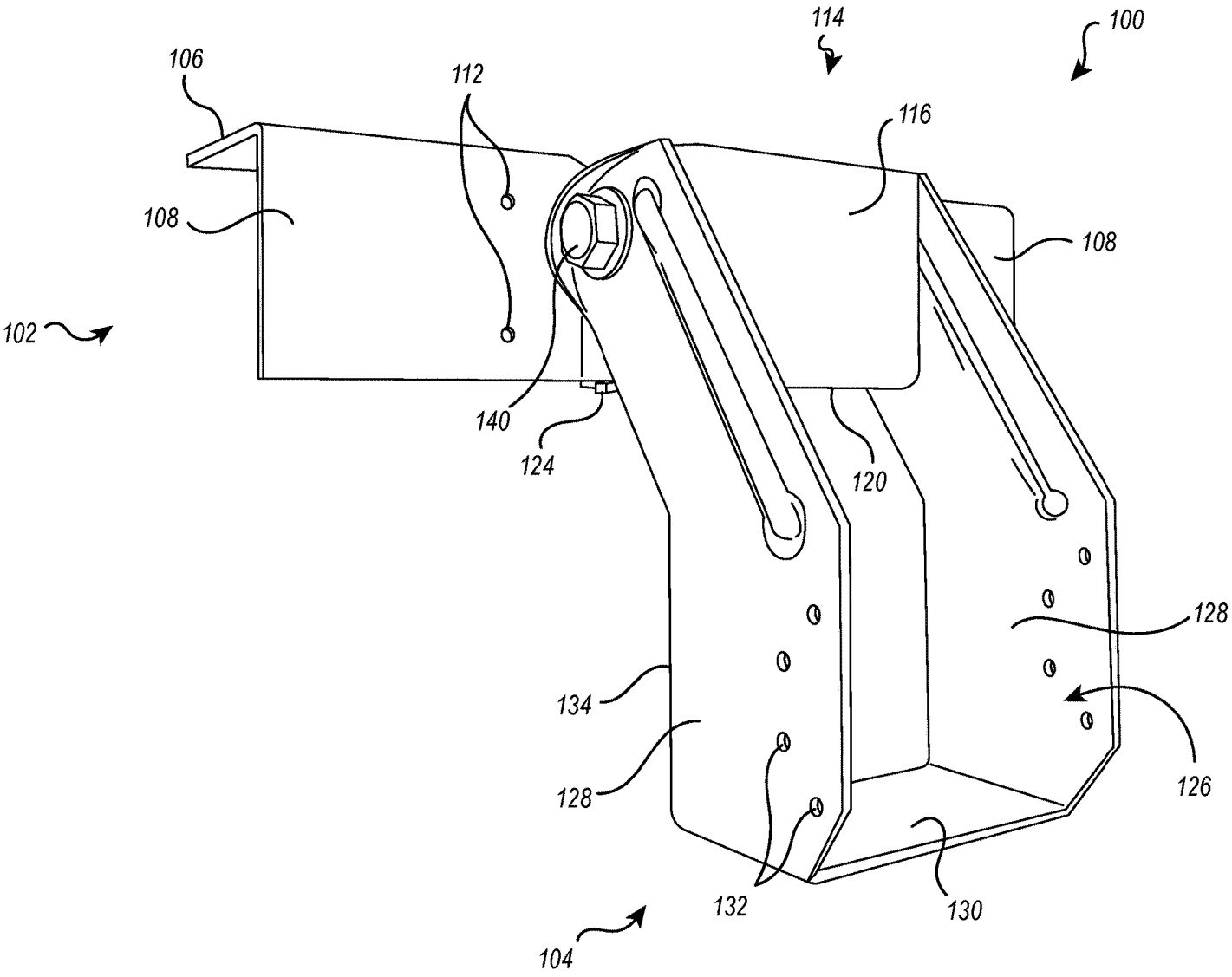
FIG. 1 illustrates a perspective view of an exemplary joist hanger.
Figure 2:
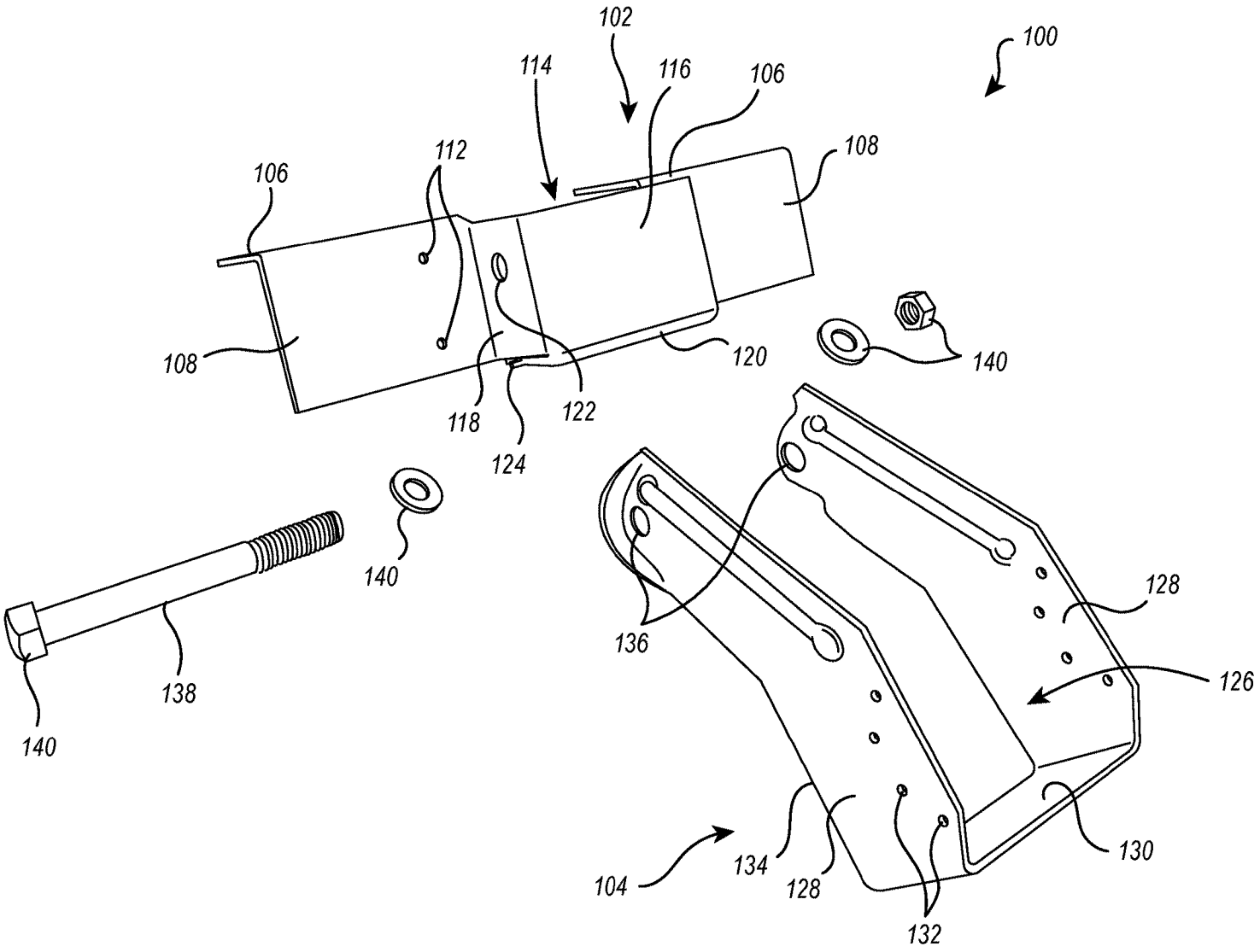
FIG. 2 illustrates an exploded perspective view of the exemplary joist hanger of FIG. 1.
Figure 3:
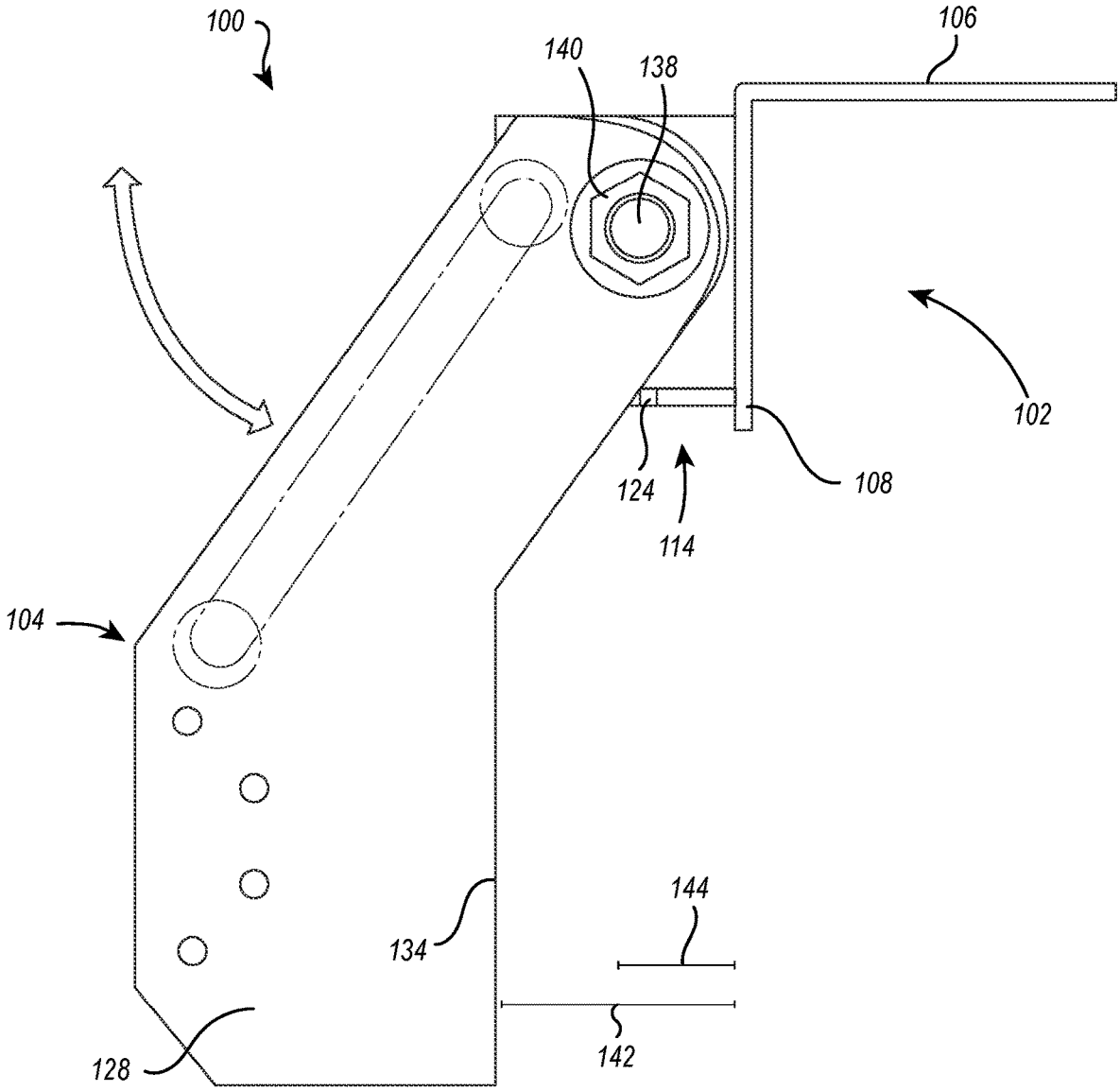
FIG. 3 illustrates a side elevational view of the exemplary joist hanger of FIG. 1.
Figure 4:
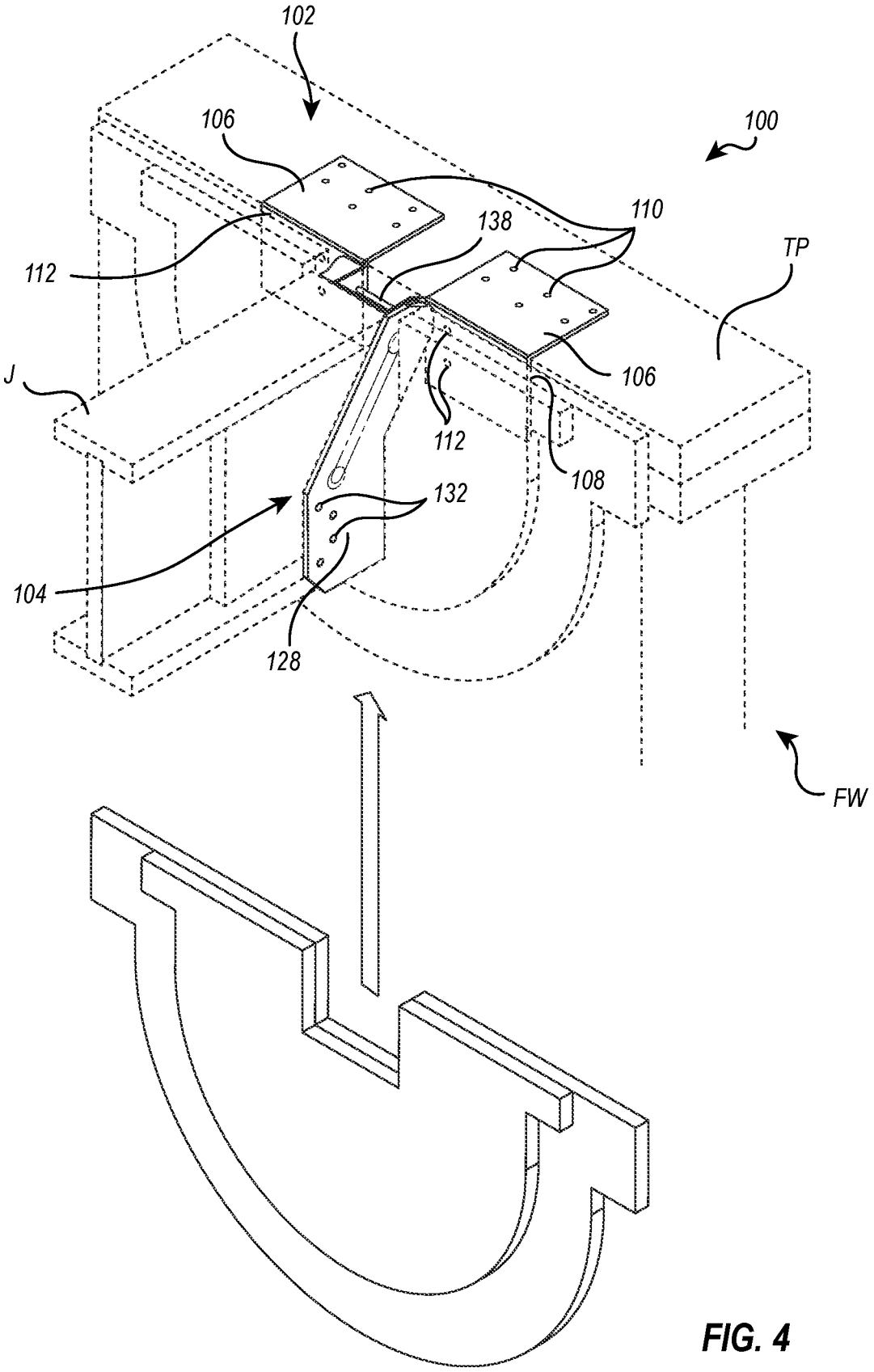
FIG. 4 illustrates a perspective view of the exemplary joist hanger of FIG. 1 in an installed configuration.

Embodiments of the present disclosure include joist hangers that can be installed directly onto the framed wall, and which are configured to leave a gap between the frame and the joist retention member that is sized and shaped to accommodate one or more fire retardant/resistant panels, which can, in some embodiments, include one or more panels of drywall. FIGS. 1-4 illustrate an exemplary joist hanger 100 in assembled, exploded, side, and installed views, respectively. The joist hanger 100 includes a mounting bracket 102 and a joist retention member 104 that may be connected together as shown in FIGS. 1, 3, and 4.

The mounting bracket 102 can be mounted to the framed wall FW and the joist retention member 104 can be connected to the mounting bracket 102. The mounting bracket 102 and the joist retention member 104 can be configured to hold the end of a joist J away from the framed wall FW by a distance that is large enough to accommodate the fire retardant/resistant panel(s) between the end of the joist J (and at least part of the joist retention member 104) and the framed wall FW.

The mounting bracket 102 may be configured to mount to a top plate TP of the framed wall FW. To facilitate such mounting, the mounting bracket 102 may include one or more horizontal flanges 106 and one or more vertical flanges 108. The horizontal flange(s) 106 and the vertical flange(s) 108 may be connected to one another or integrally formed together. The horizontal flange(s) 106 and the vertical flange (s) may be oriented at right angles relative to one another.

The horizontal flange(s) 106 include securing apertures 110 therethrough to allow the joist hanger 100 to be secured to the top plate TP of the framed wall FW, using bolts, screws, nails, or other attachment mechanism. The attachment mechanisms may extend vertically through the securing apertures 110 and into the top, horizontal surface of the top plate TP to secure the horizontal flange(s) 106 to the top plate TP. Similarly, the vertical flange(s) 108 may include securing apertures 112 therethrough to allow for further securement of the joist hanger 100 to the top plate TP of a framed wall FW, using bolts, screws, nails, or other attachment mechanism. The attachment mechanisms may extend horizontally through the securing apertures 112 and into a vertical surface of the top plate TP to secure the vertical flange(s) 108 to the top plate TP. By securing the joist hanger 100 to the framed wall FW (via the mounting bracket 102), the joist hanger 100 becomes anchored thereto, which increases the structural support, weight transfer, and load bearing capacities of the joist hanger 100. The flanges 106, 108 can also reduce the amount of deflection experienced by the joist hanger 100 when mounted and in use.

The mounting bracket 102 also includes a pivot block 114. In the illustrated embodiment, the pivot block 114 extends from or is connected to the vertical flanges 108. More specifically, the mounting bracket 102 includes two spaced apart vertical flanges 108 and the pivot block 114 extends from or is connected to interior sides of the vertical flanges 108. In the illustrated embodiment, the pivot block 114 extends in a first direction away from the vertical flanges 108 (while the horizontal flanges 106 extend in a second, opposite direction away from the vertical flanges 108).

In the illustrated embodiment, the pivot block 114 includes a front wall 116, opposing sidewalls 118, and a floor 120. The front wall 116 is generally parallel to the vertical flanges 108 and is offset from the vertical flanges 108 in the first direction. The opposing sidewalls 118 are generally parallel to one another and are oriented generally at right angles to the vertical flanges 108. The opposing sidewalls 118 include pivot features that facilitate a pivotal connection between the joist retention member 104 and the mounting bracket 102 (discussed in further detail below). In the illustrated embodiment, the pivot features comprise pivot apertures 122 therethrough that are aligned with one another. The floor extends from the front wall 116 in the second direction (towards the vertical flanges 108). In the illustrated embodiment, the floor 120 extends a substantial distance between the opposing sidewalls 118. The floor 120 (or alternatively the sidewalls 118) may include stops 124 (discussed in further detail below) that extend outwardly from the sidewalls 118.

The joist retention member 104 is sized and shaped to accommodate the end of a joist J. The joist retention member 104 includes an opening 126 that is defined on two sides by vertical support members 128 and on a bottom side by joist support platform 130. When a joist J is associated with the joist retention member 104, it is placed within the opening 126 and rests on and/or is supported by the joist support platform 130 and bounded on its sides by the vertical support members 128. The joist J can be secured to the joist retention member 104 by, for example, bolting, screwing, or nailing the vertical support members 128 to the joist J through joist securing aperture(s) 132. It should be appreciated that in some embodiments the joist J can be coupled to or otherwise associated with the joist retention member 104 using any attachment mechanism, as that term is understood and defined herein, and at one or more additional, or alternative, points than at a defined joist securing apertures 132.

In the illustrated embodiment, the vertical support members 128 have an angled configuration. For instance, a lower portion of each vertical support member 128 extends generally vertically and an upper portion thereof extends from the lower portion at an (obtuse) angle in the second direction (towards the vertical flanges 108 of the mounting bracket 102). The lower portion may have a rear edge 134 with which the end of the joist J can be aligned when the joist J is positioned within the joist retention member 104.

The upper ends of the vertical support members 128 include pivot features that are configured to facilitate the pivotal connection between the joist retention member 104 and the mounting bracket. In the illustrated embodiment, the pivot features include pivot apertures 136. When the joist hanger 100 is assembled, the upper ends of the vertical support members 128 are positioned on the outside of the sidewalls 118 of the pivot block 114 and the pivot apertures 136 are aligned with the pivot apertures 122. A pivot member 138 extends through the aligned pivot apertures 122, 136. The pivot member 138 may be a rod, bolt, cylindrical shaft. The pivot member 138 may be secured in place via one or more attachment mechanisms 140 (e.g., bolt head, nut, washers, pins, etc.). The pivot member 138 may extend generally horizontally when the joist hanger 100 is installed.

While the pivotal connection between the joist retention member 104 and the mounting bracket 102 is primarily described herein as including pivot apertures and a pivot member that extends therethrough, this is merely exemplary. It is contemplated that the joist retention member 104 and the mounting bracket 102 may be pivotally connected to one another in a variety of ways and using a variety of other types of connection features. As discussed herein, the pivotal connection can allow for the joist retention member 104 to pivot about a generally horizontal pivot axis when the joist hanger 100 is installed on a framed wall FW.

With the joist retention member 104 connected to the mounting bracket 102 with the pivot member 138, the joist retention member 104 may pivot about the pivot member 138 and relative to the mounting bracket 102. Because the pivot member 138 is oriented generally horizontally, the joist retention member 104 may pivot about a pivot axis that is also oriented generally horizontally (when the joist hanger 100 is installed). The stops 124 of the pivot block 114 may limit the range of motion of the joist retention member 104 in at least one direction. For instance, the stops 124 may be positioned so as to engage the vertical support members 128 and limit further movement thereof when the joist support platform 130 is oriented horizontally.

As best illustrated in FIGS. 3 and 4, the placement/configuration of the pivot block and the angled configuration of the vertical support members 128 creates a horizontal offset or gap 142 between the rear edges 134 of the lower portions of the vertical support members 128 and the vertical flanges 108. The gap 142 is large enough to allow for one or more sheets of drywall or other fire-resistant panels to be positioned therein. For instance, the gap 142 may be large enough to accommodate two sheets of ⅝ inch drywall therein. Thus, in some embodiments, the gap 142 is about 1.25 inches. In other embodiments, the gap 142 may be about 1.5 inches, about 2 inches, 2.5 inches, or other values less than, between, or greater than any of the noted values.

The pivoting connection between the mounting bracket 102 and the joist retention member 104 and the gap 142 formed between the vertical flanges 108 and the lower portion of the joist retention member 104 provide the joist hanger with certain beneficial characteristics. As noted above, the gap 142 allows for fire-resistance panel(s) to be positioned between the end of the joist J and the framed wall FW, thereby providing fire barrier therebetween.

While spacing the end of the joist J away from the framed wall FW and positioning panel(s) therebetween provides fire-resistant characteristics, it can also provide some challenges. For instance, because the joist retention member 104 extends further away from the mounting bracket 102 to create the gap 142 between the joist J and the framed wall FW, joist retention member 104 and the weight of the joist J would act as a lever or moment arm that would tend to cause the joist hanger 100 to rotate, which can cause the top plate TP of the framed wall FW to undesirably twist. The length of the lever or moment arm would be equal to or greater than the length of the gap 142.

However, the pivoting connection between the mounting bracket 102 and the joist retention member 104 can significantly reduce or eliminate the twisting of the top plate TP. More specifically, because the joist retention member 104 can rotate about the pivot member 138, the length of the lever or moment arm is decreased from the length of the gap 142 to an offset or gap 144 between the vertical flanges 108 and the pivot member 138. As can be seen in FIG. 3, the gap 144 is significantly smaller than the gap 142. In the illustrated embodiment, the gap 144 is about half the size of the gap 142. In other embodiments, the gap 144 may be about three-quarters, two-thirds, one-third, one-quarter, or any other value below or between the noted values compared to the size of the gap 142.

In use, the mounting bracket 102 can be installed on the top plate TP with one or more attachment mechanisms being inserted through the securing apertures 110, 112 and into the top plate TP. If not completed prior to installation of the mounting bracket 102, the joist retention member 104 may then be secured to the mounting bracket 102. This can be accomplished by aligning the pivot apertures 136 of the joist retention member 104 with the pivot apertures 122 of the pivot block 114, inserting the pivot member 138 through the aligned pivot apertures 122, 136, and securing the pivot member 138 in place with one or more attachment mechanisms 140.

Once the joist hanger 100 is assembled and installed, the end of the joist J can be inserted into the joist retention member 104. More specifically, the end of the joist J can be inserted between the vertical support members 128 and positioned on the joist support platform 130. The end of the joist J can be aligned with the rear edges 134 of the vertical support members 128. The weight of the joist J may cause the joist retention member 104 to pivot or rotate about the pivot member 138 until the vertical support members 128 engage the stops 124. The joist J can then be secured to the joist retention member 104 by inserting one or more attachment mechanisms through the joist securing apertures 132 and into the joist J.

With the joist hanger 100 and the joist J installed, the fire-resistant panel(s) can be installed. As shown in FIG. 4, a notch 146 may be cut into the panel(s). The notch 146 may have a height and a width. The height of the notch 146 may be about equal to or greater than the height of the vertical flanges 108 and/or the pivot block 114. The width of the notch 146 may be about equal to or greater than the width of the vertical support members 128. In some embodiments, the width of the notch 146 is equal to or greater than the width of the pivot member 138 and any attachment mechanism 140 connected to the ends thereof.

With the notch(es) 146 cut into the fire-resistant panel(s), the fire-resistant panel(s) can be inserted into the gap 142. When the fire-resistant panel(s) are so positioned, the notch (es) 146 extend at least partially around the connection between the mounting bracket 102 and the joist retention member 104 and the panel(s) are positioned between the end of the joist J and the framed wall FW. The panel(s) can then be secured to the framed wall FW.

Unless defined otherwise, all technical and scientific terms used herein have the same meaning as commonly understood by one of ordinary skill in the art to which the present disclosure pertains. To assist in understanding the scope and content of the foregoing and forthcoming written description and appended claims, a select few terms are defined directly below.

As used herein, the term "attachment mechanism" includes any device in one or more pieces that may be used to "attach" two or more components or to "attach" one component to another component. The term "attach" and/or "attachment" may refer to its common dictionary definition where appropriate, but it may contextually refer to particular acts of connecting, associating, affixing, fastening, sticking, joining, or any combination of the foregoing that cause an object to be fixedly or selectively proximate another object. In some embodiments, the attachment mechanism may be an integral part of a component, whereas in other embodiments, the attachment mechanism may be separate.

An attachment mechanism is to be understood to have any number of movable and/or fixed parts, any of which may be singular or in combination with one or more components interact to facilitate attachment. As non-limiting examples, an attachment mechanism may include a mechanism for attaching components using one or more—or a combination of—chemical adhesives (e.g., an epoxy and/or other thermosetting adhesives, glue, cement, paste, tape and/or other pressure-sensitive adhesives, etc.), mechanical fasteners (e.g., threaded fasteners such as a combination of a threaded rod together with a complementary threaded nut, rivets, screw, clamp, buckle, tenon and mortise pairs, cable ties, rubber bands, etc.), magnets, vacuums (e.g., suction cups, etc.), and/or interference fittings (e.g., press fittings, friction fittings, etc.). Additionally or alternatively, an attachment mechanism may include any material or element resulting from physically attaching two or more components by crimping, welding, and/or soldering.

The term "drywall," as used herein, is intended to include wall elements or panels that are constructed and/or made from one or more of plaster, gypsum (i.e., calcium sulfate dihydrate), wood pulp, or other materials and which may include a facer and backer comprised of paper or similar material. When implemented as a building material, drywall is typically used to form the interior walls of a building or other structure. It should be appreciated that the term "drywall" is intended to encompass similar and/or synonymous building materials, such as "plasterboard," "wallboard," "gypsum panel," "sheet rock," and/or "gypsum board."

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein.

As used herein, directional terms, such as "top," "bottom," "left," "right," "up," "down," "upper," "lower," "proximal," "distal" and the like are used herein solely to indicate relative directions and are not otherwise intended to limit the scope of the disclosure and/or claimed invention.

Any headings used herein are for organizational purposes only and are not meant to be used to limit the scope of the description or the claims.

To facilitate understanding, like reference numerals (i.e., like numbering of components and/or elements) have been used, where possible, to designate like elements common to the figures. Specifically, in the exemplary embodiments illustrated in the figures, like structures, or structures with like functions, will be provided with similar reference designations, where possible.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A joist hanger, comprising:

a mounting bracket comprising a pivot block, the pivot block comprising one or more stops; and a joist retention member configured to be pivotally connected to the pivot block of the mounting bracket, the joist retention member being configured to pivot about a generally horizontal pivot axis when the joist hanger is mounted on a wall, the joint retention member being configured to engage the one or more stops to limit a pivoting range of motion of the joist retention member.

2. The joist hanger of claim 1, wherein the mounting bracket comprises one or more flanges configured to be attached to the wall.

3. The joist hanger of claim 2, wherein the one or more flanges comprise one or more horizontal flanges and one or more vertical flanges.

4. The joist hanger of claim 1, wherein the pivot block comprises two opposing sidewalls with pivot features configured to facilitate the pivotal connection between the joist retention member and the mounting bracket.

5. The joist hanger of claim 4, wherein the pivot features comprise a pivot aperture in each of the two opposing sidewalls, the pivot apertures being aligned with one another.

6. The joist hanger of claim 1, wherein the joist retention member comprises first and second vertical support members and a joist support platform extending therebetween.

7. The joist hanger of claim 6, wherein each of the first and second vertical support members comprises a lower portion and an upper portion that are angled relative to one another.

8. The joist hanger of claim 7, wherein the upper portions of the first and second vertical support members each comprise a pivot feature configured to facilitate the pivotal connection between the joist retention member and the mounting bracket.

9. The joist hanger of claim 8, wherein the pivot features comprise aligned pivot apertures.

10. The joist hanger of claim 7, wherein the angled configuration of the first and second vertical support members is configured to offset an end of a joist from the wall.

11. A joist hanger, comprising:

a mounting bracket comprising:

one or more vertical flanges;

one or more horizontal flanges; and a pivot block extending in a first direction from the one or more vertical flanges, the pivot block comprising one or more pivot features; and a joist retention member pivotally connected to the mounting bracket, the joist retention member comprising first and second vertical support members, each of the first and second vertical support members comprising a pivot feature, the pivot features of the first and second vertical support members being configured to cooperate with the one or more pivot features of the pivot block to pivotally connect the joist retention member to the mounting bracket such that joist retention member can pivot about a generally horizontal pivot axis when the joist hanger is mounted on a wall, each of the first and second vertical support members comprising a vertical lower portion with a rear edge and an upper portion that is angled towards the one or more vertical flanges, the angled configuration of the first and second vertical support members being configured to create a gap between the rear edges and the one or more vertical flanges configured to receive one or more fire-resistant panels.

12. The joist hanger of claim 11, wherein the pivot features comprise aligned pivot apertures.

13. The joist hanger of claim 12, further comprising a pivot member that is configured to extend through the aligned pivot apertures to pivotally connect the joist retention member to the mounting bracket.

14. The joist hanger of claim 11, wherein the generally horizontal pivot axis is disposed above the gap and about halfway between the one or more vertical flanges and the rear edges of the first and second vertical support members.

15. A joist hanger, comprising:

a mounting bracket comprising:

one or more vertical flanges;

one or more horizontal flanges; and a pivot block extending in a first direction from the one or more vertical flanges, the pivot block comprising opposing sidewalls, each of the opposing sidewalls having a pivot aperture;

a joist retention member configured to be pivotally connected to the mounting bracket, the joist retention member comprising first and second vertical support members, each of the first and second vertical support members comprising a lower portion and an upper portion that are angled relative to one another, each of the upper portions of the first and second vertical support members comprising a pivot aperture, the pivot apertures of the first and second vertical support members being configured to be aligned with the pivot apertures of the pivot block; and a pivot member configured to extend through the pivot apertures of the pivot block and the first and second vertical support members to pivotally connect the joist retention member to the mounting bracket such that joist retention member can pivot about a generally horizontal pivot axis when the joist hanger is mounted on a wall.

16. The joist hanger of claim 15, wherein the first end second vertical support members each have a lower portion with a rear edge, wherein the configuration of the first and second support members and the connection between the joist retention member and the mounting bracket creates a gap between the rear edges and the vertical flanges, the gap being configured receive one or more fire-resistant panels disposed therein.

17. The joist hanger of claim 16, wherein the pivot member is disposed about halfway between the rear edges and the one or more vertical flanges.

* * * * *